US008182250B2

(12) United States Patent
White, Jr.

(10) Patent No.: US 8,182,250 B2
(45) **Date of Patent: *May 22, 2012**

(54) GEROTOR MOTOR AND BRAKE ASSEMBLY

(75) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 232 days.

This patent is subject to a terminal disclaimer.

(21) Appl. No.: 12/729,500

(22) Filed: Mar. 23, 2010

(65) Prior Publication Data

US 2010/0178188 A1 Jul. 15, 2010

Related U.S. Application Data

(63) Continuation of application No. 11/382,171, filed on May 8, 2006, now Pat. No. 7,695,258.

(51) Int. Cl.
*F03C 2/00* (2006.01)
*F03C 4/00* (2006.01)
*F04C 18/00* (2006.01)

(52) U.S. Cl. ..... 418/61.3; 418/69; 188/71.5; 188/72.3; 188/166; 188/170

(58) Field of Classification Search ..... 418/61.3, 418/69; 188/71.5, 72.1–72.3, 166, 170
See application file for complete search history.

(56) References Cited

U.S. PATENT DOCUMENTS 2,195,834 A 4/1940 Bilderbeck
2,527,290 A * 10/1950 Anderson ..... 188/151 R
2,678,155 A 5/1954 Durham
3,616,882 A 11/1971 White
3,960,470 A 6/1976 Kinder
4,285,643 A 8/1981 White
4,739,865 A 4/1988 Yater et al.
4,981,423 A 1/1991 Bissonnette
5,114,324 A 5/1992 Spindeldreher
5,333,705 A 8/1994 Lemaire et al.
5,390,495 A 2/1995 Lemaire
6,030,194 A 2/2000 Yakimow et al.
6,132,194 A 10/2000 Wenker et al.
6,145,635 A * 11/2000 White ..... 188/71.5
6,253,882 B1 * 7/2001 White ..... 188/71.5
6,345,968 B1 2/2002 Shupe
6,743,002 B1 6/2004 Millar et al.
6,826,909 B2 12/2004 Walls
7,287,969 B2 10/2007 Fugle

* cited by examiner

*Primary Examiner* — Theresa Trieu

(74) *Attorney, Agent, or Firm* — Rankin, Hill & Clark LLP

(57) ABSTRACT

A hydraulic device includes a gerotor assembly, a wobble stick, an output shaft, a housing assembly, first and second ports, first and second brake disks, a piston, and a biasing member. The gerotor assembly includes a rotor and a stator. The housing assembly receives the gerotor assembly, the wobble stick and the output shaft. The first and second ports are in communication with the gerotor assembly. The piston is disposed in the housing assembly adjacent at least one of the brake disks. The piston cooperates with the housing assembly to define a brake pressure chamber. The housing assembly and the first and second ports are configured such that pressurization of either port results in pressurization of the brake pressure chamber. The biasing member is disposed in the housing and contacts the piston. The biasing member urges the piston toward at least one of the brake disks.

11 Claims, 5 Drawing Sheets

GEROTOR MOTOR AND BRAKE ASSEMBLY

This application is a continuation of application Ser. No. 11/382,171, filed May 8, 2006 now U.S. Pat. No. 7,695,258, which is incorporated by reference herein in its entirety.

BACKGROUND

Hydraulic devices that include a hydraulic motor and a brake assembly typically include large housings and/or complicated drive connections. An example of a known hydraulic motor and brake assembly includes a seal that blocks fluid flow between the brake assembly and the hydraulic motor. Accordingly, the known assembly includes a large housing having at least three fluid ports: two fluid ports for the motor and one fluid port for the brake This construction requires a larger housing and a complicated fluid path.

Another known motor and brake assembly includes a gerotor motor of the type having a spool valve that connects to a main output drive shaft. The output end of the main output drive shaft is disposed on one side of the rotor assembly and the spool valve and brake assembly are disposed on an opposite side of the gerotor assembly. Such a configuration requires complicated attachment of the spool valve to the main output drive shaft and a portion of the main output drive shaft orbits and rotates. Furthermore, the spool valve includes an extension to which brake disks are attached, thus requiring a larger housing assembly for the hydraulic device.

SUMMARY OF THE INVENTION

A hydraulic device that includes a hydraulic motor and a brake assembly that overcomes the aforementioned shortcomings includes a compact housing assembly and fewer complicated fluid paths as compared to the known previously discussed assemblies. An embodiment of a hydraulic device includes a housing, an output shaft a rotor assembly, a wobble shaft, and a brake assembly. The housing includes a central opening, a fluid inlet passage, and a fluid outlet passage. The housing at least partially defines a pressurizable brake chamber in fluid communication with the inlet passage. The output shaft is received in the central opening of the housing and extends from the housing. The rotor assembly includes a stator and a rotor having cooperating teeth defining fluid pockets. The rotor rotates and orbits relative to the stator when hydraulic fluid is directed toward the fluid pockets. The fluid pockets are in communication with the fluid inlet passage and the fluid outlet passage. The wobble shaft connects to the rotor and to the output shaft to rotate the output shaft upon rotational and orbital movement of the rotor. The brake assembly includes first brake disks, second brake disks, a piston, and a biasing member. The first brake disks connect to the output shaft The second brake disks connect to the housing. The piston contacts at least one of the brake disks. The biasing member urges the piston to an operating condition braking the output shaft. The output shaft can include a knurled outer surface.

According to another embodiment, a hydraulic device includes a gerotor assembly, a wobble stick, an output shaft, a housing assembly, a first port in the housing assembly, a second port in the housing assembly, first brake disks, second brake disks, a piston, and a biasing member The gerotor assembly includes a rotor and a stator. The wobble stick connects at a first end to the rotor. The output shaft connects to a second end of the wobble stick. The housing assembly receives the gerotor assembly, the wobble stick and the output shaft. The first port is in communication with the gerotor assembly. The second port is also in communication with the gerotor assembly. The first brake disks connect to the output shaft. The second brake disks connect to the housing assembly. The piston is disposed in the housing assembly adjacent at least one of the brake disks. The piston cooperates with the housing assembly to define a brake pressure chamber. The housing assembly and the first and second ports are configured such that pressurization of either port results in pressurization of the brake pressure chamber. The biasing member is disposed in the housing and contacts the piston The biasing member urges the piston toward at least one of the brake disks.

According to another embodiment, a spool valve-type hydraulic device includes a housing, a spool valve disposed in the housing, a gerotor assembly cooperating with the spool valve, and a spring applied/pressure released brake assembly cooperating with the spool valve and the housing. The housing defines first and second ports. The spool valve includes a portion extending axially from the housing having an output end configured to connect to an associated device such as a wheel or a motor. The gerotor assembly communicates with the first and second ports. Pressurization of either port results in the spring applied/pressure released brake assembly operating in a disengaged position which allows for rotation of the spool valve.

The aforementioned hydraulic devices can include mechanisms to allow for the pressurization of the brakes and/or brake assemblies that were described above to operate in a disengaged position to allow for rotation of the hydraulic motor while the hydraulic motor is not receiving fluid through either of the inlet or outlet ports. The aforementioned hydraulic devices can also include knurled surfaces to promote the formation of fluid coated bearing surfaces.

DETAILED DESCRIPTION

The hydraulic device described below includes a hydraulic motor and a brake assembly. The device provides a small brake package that can inhibit the motor from rotating when the motor is in an unpressurized condition. The brake assembly can be disengaged when pressure is delivered to either port of the motor.

Figure 1:
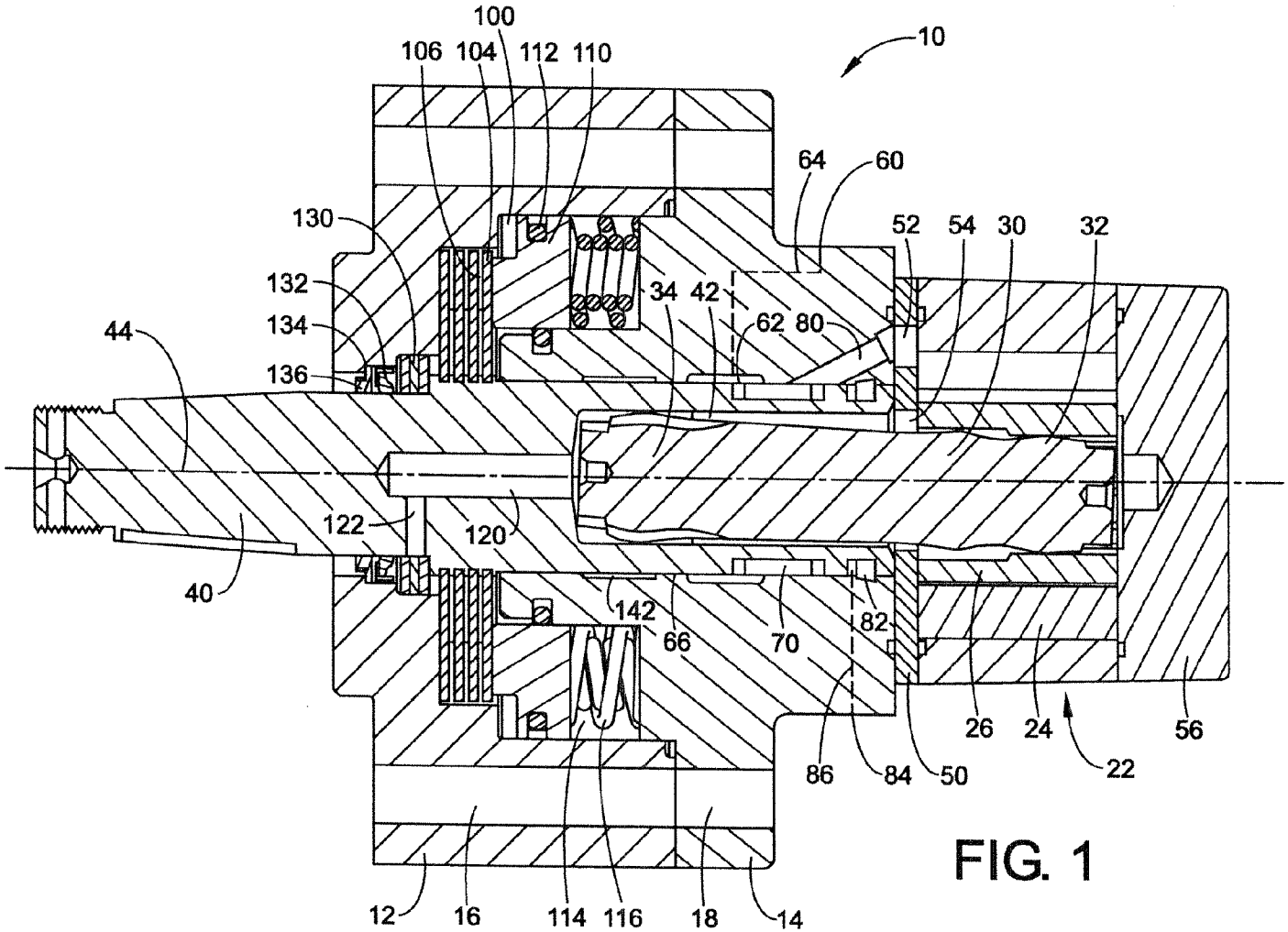
FIG. 1 is a central sectional view of a hydraulic device that includes a hydraulic motor and brake assembly.

With reference to FIG. 1, the hydraulic device 10 includes a housing assembly that includes a front housing section 12 and a rear housing section 14. The housing sections attach to one another via bolts (not shown) received in bolt holes 16 and 18 formed in the housing sections.

A rotor assembly 22 connects to the rear housing section 14. In the depicted embodiment, the rotor assembly 22 is similar to a known gerotor assembly that includes a stator 24 and a rotor 26. The rotor 26 includes a plurality of teeth that cooperate with the stator 24 in a known manner to define expanding fluid pockets and contracting fluid pockets as the rotor rotates and orbits relative to the stator when hydraulic fluid is directed toward the expanding pockets.

A wobble stick 30, also referred to as a drive link or a wobble shaft, connects to the rotor 26 at a first end 32. The wobble stick 30 can attach to the rotor 26 via a splined connection, which is known in the art. The first end 32 of the wobble stick 30 rotates and orbits relative to the stator 24 as the rotor 26 rotates and orbits relative to the stator. A second end 34 of the wobble shaft 30 connects to an output shaft 40.

The output shaft 40 includes a central opening 42 aligned along its rotational axis 44. The wobble stick 30 attaches to the output shaft 40 via a splined connection, which is known in the art. Orbital movement of the rotor 26 relative to the stator 24 is translated into rotational movement of the output shaft 40 about its rotational axis 44.

A wear plate 50 is sandwiched between the rear housing section 14 and the rotor assembly 22. The wear plate 50 includes a plurality of openings 52 radially spaced from the rotational axis 44 of the output shaft 40. The openings 52 in the wear plate 50 communicate with the cells (either expanding or contracting) formed in the rotor assembly in a manner that is known in the art. Accordingly, the number of openings 52 equals the number of cells.

An end plate 56 attaches to the gerotor assembly 22 on an opposite side of the gerotor assembly as the wear plate 50. In the depicted embodiment, the end plate 56 closes the housing assembly for the moveable components of the device 10.

When the hydraulic device 10 operates as a motor, rotation of the output shaft 40 is caused by delivering pressurized fluid to the expanding cells of the rotor assembly 20. The hydraulic device 10 can also operate as a pump when the output shaft 40 is driven by an external power device, for example a gasoline or diesel engine. A first port 60 (depicted schematically) communicates with a fluid source (not shown) and a first annular groove 62 formed in the rear housing section 14 via a passage 64 (depicted schematically). The first annular groove 62 extends radially outward from and directly communicates with a central opening 66 formed in the rear housing section 14 that receives the output shaft 40.

Figure 3:
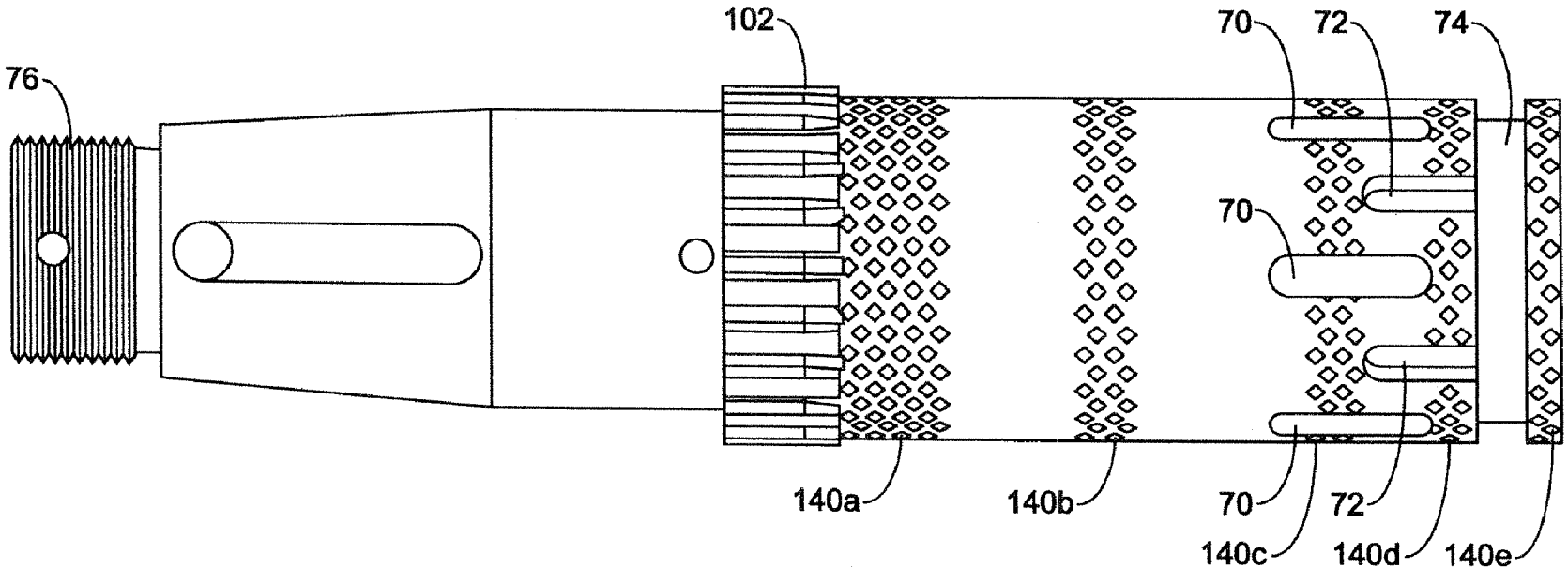
FIG. 3 is a side elevation view of an output shaft of the hydraulic device of FIG. 1.

With reference to FIG. 3, the output shaft 40 acts as a spool valve in that it includes first axial slots 70 and second axial slots 72. The axial slots are also referred to as timing slots or feed slots in the art. The second axial slots 72 communicate with an annular groove 74 formed in the output shaft 40 adjacent an end that is opposite an output end 76 that attaches to an associated device, for example a wheel or an engine.

With reference back to FIG. 1, the first annular groove 62 selectively communicates with the first axial slots 70 formed in the output shaft 40. Generally axially aligned passages 80 (one shown in FIG. 1) extend between the central opening 66 of the rear housing section 14 and the appropriate openings 52 in the wear plate 50. The axially aligned passage 80 communicates with the central opening 66 of the rear housing section 14 at a location that is axially spaced from the first annular groove 62 while allowing for communication with the axial slots 70 and 72 of the output shaft 40 as the output shaft rotates.

Fluid enters the pockets in the rotor assembly 22 via the openings 52 in the wear plate 50 on one side of the line of eccentricity of the rotor assembly and exits the rotor assembly via openings 52 in the wear plate 50 on the opposite side of the line of eccentricity. A second annular groove 82 formed in the rear housing section 14 communicates with the second set of axial slots 72 (FIG. 3) formed in the output shaft 40 and the openings 52 in the wear plate. The second annular groove 82 in the rear housing section 14 communicates with an outlet port 84 via a passage 86 (both depicted schematically in FIG. 1).

Figure 2:
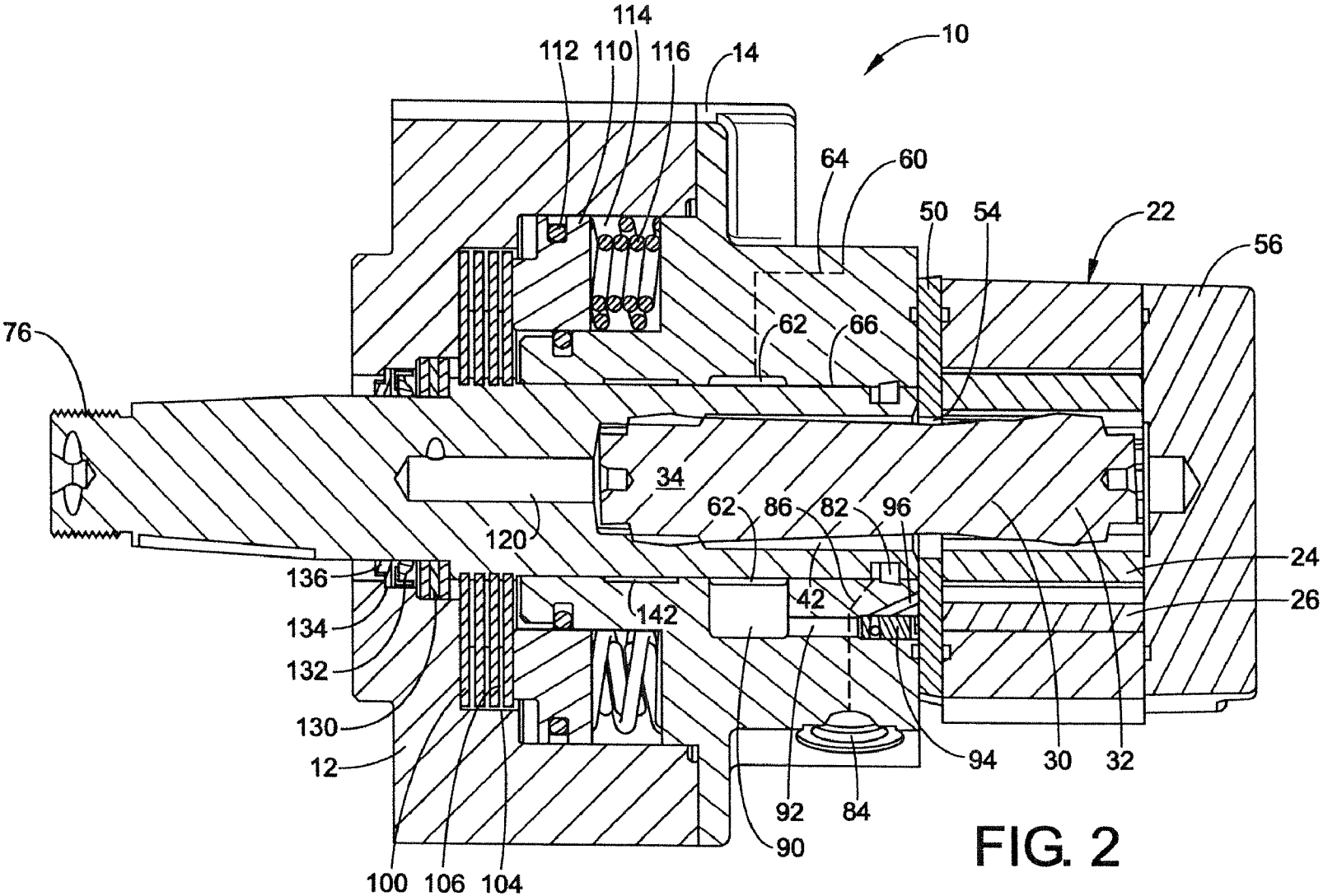
FIG. 2 is a sectional view of the hydraulic device of FIG. 1 taken along a plane to show passages on an opposite side of a line of eccentricity of a gerotor set as that shown in FIG. 1.

FIG. 2 depicts a cross-sectional view through the hydraulic device 10 showing passages in the rear housing section 14 that are on an opposite side of the line of eccentricity of the rotor assembly 22 as that shown in FIG. 1. A radial passage 90 extends from the first annular groove 62 and communicates with an axially aligned passage 92. A valve 94 is disposed in the passage 92 to selectively block flow from the annular groove 62 toward the pockets of the rotor assembly 22. An angled passage 96 connects the axially aligned passage 92 to a rear surface of the rear housing section 14 that abuts the wear plate 50. The angled passage 96 allows pressurized fluid to travel towards the central opening 54 of the wear plate 50 and the valve 94 precludes this pressurized fluid from entering into the rotor assembly 22, The valve 94, which in the depicted embodiment is a shuttle valve, allows flow from the rotor assembly 22 into the angled passage 96 while precluding fluid from traveling toward the first annular groove 62 and thus the first port 60.

With reference back to FIG. 1, pressurized fluid travels through a passageway, which will be described in more detail below, to pressurize a brake chamber 100 that is defined in the housing assembly of the device 10. No matter which port, either port 60 or port 84, serves as an inlet for the hydraulic motor, the brake chamber 100 is pressurized. This is due, at least in part, to the shuttle valve 94. In the depicted embodiment, the same ports that are used to operate the gerotor assembly 22 also pressurize the brake chamber 100.

The brake assembly for the device will be described in more detail. With reference to FIG. 3, the output shaft 40 includes a splined portion 102 that receives friction disks 104 (FIG. 1) that are appropriately shaped so that the friction disks rotate along with the output shaft 40. With reference to FIG. 1, disk stampings 106 attach to the front housing section 12 in a known manner so that the disk stampings do not rotate with respect to the output shaft 40. The brake package, i.e. the friction disks and the disk stampings, are located nearer an outer end of the device 10 and the output shaft 40 than the end plate 56. In other words, the brake package is disposed "forwardly" of the gerotor assembly. The timing slots of the output shaft 40, the brake package, and the output end 76 of the output shaft are all disposed on the same side of the gerotor assembly 22, which simplifies construction of the device 10.

In the depicted embodiment, a piston 110 contacts one of the friction disks 104. Alternatively, the piston 110 can contact one of the disk stampings 106 if the orientation was slightly changed. A seal 112 contacts the piston 110 and the front housing section 12 thus separating the brake chamber 100 from a cavity 114 that receives a biasing member, for example a spring 116, that urges the piston 110 towards the friction disk 104. When the brake chamber 100 is unpressurized the spring 116 urges the piston 110 towards the friction disk 104 and the friction disks contact the disk stampings 106 thereby inhibiting the rotation of the output shaft 40.

With reference to FIG. 1, as indicated before, pressurized fluid is delivered to the brake chamber 100, thus disengaging the brake, when fluid is delivered into either port 60 or 84 of the device 10. Fluid travels through the central opening 54 of the wear plate 50 into the central opening 42 of the output shaft 40 into an axially aligned passage 120 and into a radially aligned passage 122.

A thrust bearing assembly 130, which in the depicted embodiment includes two washers having a thrust bearing sandwiched between them, surrounds the output shaft 40 at a location that is aligned with the radial passage 122 of the output shaft 40. A seal retainer 132 that retains a seal 134 fits around the output shaft outside of the thrust bearing assembly 130. A dust cover 136 fits around the output shaft 40 to protect the seal 134 and other internal components. The seal 134 cooperates with the front housing section 12, the seal retainer 132 and the output shaft 40 to define a boundary of the brake chamber 100.

Pressurized fluid passes through the thrust bearing assembly 130, which can act as a sort of miniature pump, to pressurize the brake chamber 100. When pressurized, the fluid acts on the piston 110 urging it away from the friction disks 104.

The hydraulic device 10 can be a "bearingless" device in that the depicted embodiment does not include bearings, other than the thrust bearing assembly 130. With reference to FIG. 3, the output shaft 40 includes knurled sections 140*a*-140*e* formed on an outer surface so that the fluid resides in the device 10 can travel into the knurled sections to act as a bearing between the output shaft and the housing assembly The knurled sections can comprise a plurality of small depressions that are not interconnected with one another. Fluid can leak, for example from the brake chamber 100, or be introduced into the central opening 66 that receives the output shaft 40. The plurality of non-interconnected small depressions inhibit unwanted leakage between the fluid residing in the knurled sections that is acting as a bearing and other fluid paths in the hydraulic device.

The knurled sections are disposed along the output shaft 40 at locations that contact, or are adjacent, bearing surfaces of the housing assembly. In the depicted embodiment, the left-hand most knurled section 140*a* extends from the splined section 102 on the output shaft 40 to adjacent a portion of the output shaft 40 that is radially aligned with a third annular groove 142, which will be described in more detail below. A second knurled section 140*b* extends between the third annular groove 142 and the first annular groove 62. A third knurled section 140*c* extends between the first annular groove 62 and the opening of the angled passage 80 The fourth knurled section 140*d* extends between the opening of the angled passage 80 and the second annular groove 82. The fifth knurled section 140*e* extends between the second annular groove 82 and the end of the output shaft 40. The knurled sections need not be located exactly where they have been described; however, in the depicted embodiment portions of the output shaft have not been knurled to facilitate valving, e.g. the section between 140*c* and 140*d*, or because the central opening 42 of the output shaft 40 is ball checked to pressure.

That the central opening 42 of the output shaft 40 is ball checked to pressure is one reason for the third annular groove 142, which is axially spaced from the first and the second annular grooves 62 and 82, respectively. Since the central opening 42 is typically under pressure when the device 10 is operating, the third annular groove 142 allows the output shaft 40 to expand under pressure exerted from inside the central opening. If desired, the third annular groove 142 can be ball checked to low pressure, i.e. the port that is acting as the outlet for the device, to facilitate cooling of the output shaft 40 and other components of the device. Likewise, the cavity 114 that receives the spring 116 can also be ball checked to low pressure, if desired, to also facilitate cooling.

Figure 4:
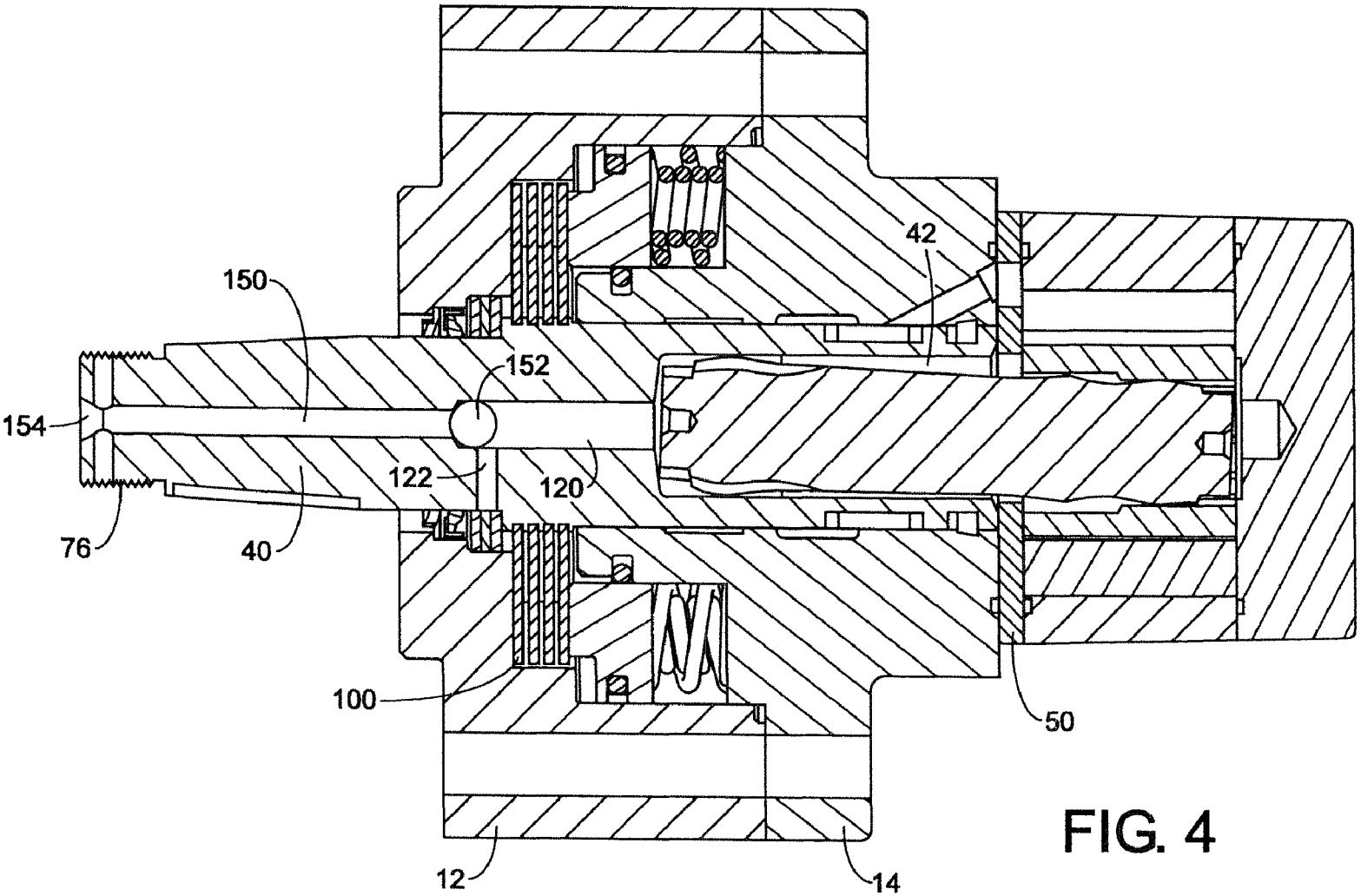
FIG. 4 is a central sectional view, similar to that shown in FIG. 1, of a hydraulic pressure device that includes an additional passage for allowing the brake assembly to be disengaged.

With reference to FIG. 4, a means by which the brake assembly can be disengaged if fluid is not being delivered to the motor portion of the assembly is shown. The assembly depicted in FIG. 4 is the same as the assembly depicted in FIG. 1 with the exception of the components that will be described below. Accordingly, for the sake of brevity like numerals will refer to like components. The output shaft 40 includes an additional axial passage 150 that communicates with the axial passage 120, which is in communication with the central opening 42 of the output shaft and the radial opening 122. In the embodiment depicted in FIG. 4, a ball 152 is disposed in the axial opening 120 to block flow from the axial opening 120 into the axial opening 150 thus directing flow into the radial passage 122 to pressurize the brake chamber 100. When fluid is not being delivered through the central opening 42, a source of fluid, for example any type of pump, can communicate with an opening 154 located in the output end 76 of the output shaft 40 to provide fluid into the axial passage 150 moving the ball 152 toward the central opening 42 in the output shaft 40. Accordingly, pressurized fluid is blocked from moving from the axial opening 120 into the central opening 42 and thus moves into the radial opening 122 and towards the brake chamber 100. The embodiment depicted in FIG. 4 discloses a simplified shuttle-type valve; however, other known valving mechanisms can be used to pressurize the brake chamber 100 when it is not receiving pressurized fluid from the pressure source that operates the hydraulic motor portion of the hydraulic device 10. Likewise, the passage 150 can be located elsewhere in the assembly, for example in the wear plate and/or the rear housing section 14 to provide for fluid communication with the central opening 42 of the output shaft 40 to deliver pressurized fluid to the brake pressure chamber 100. Also, a fluid passage can be provided in the front housing section 12 to provide a fluid path between the brake chamber 100 and the ambient.

Figure 5:
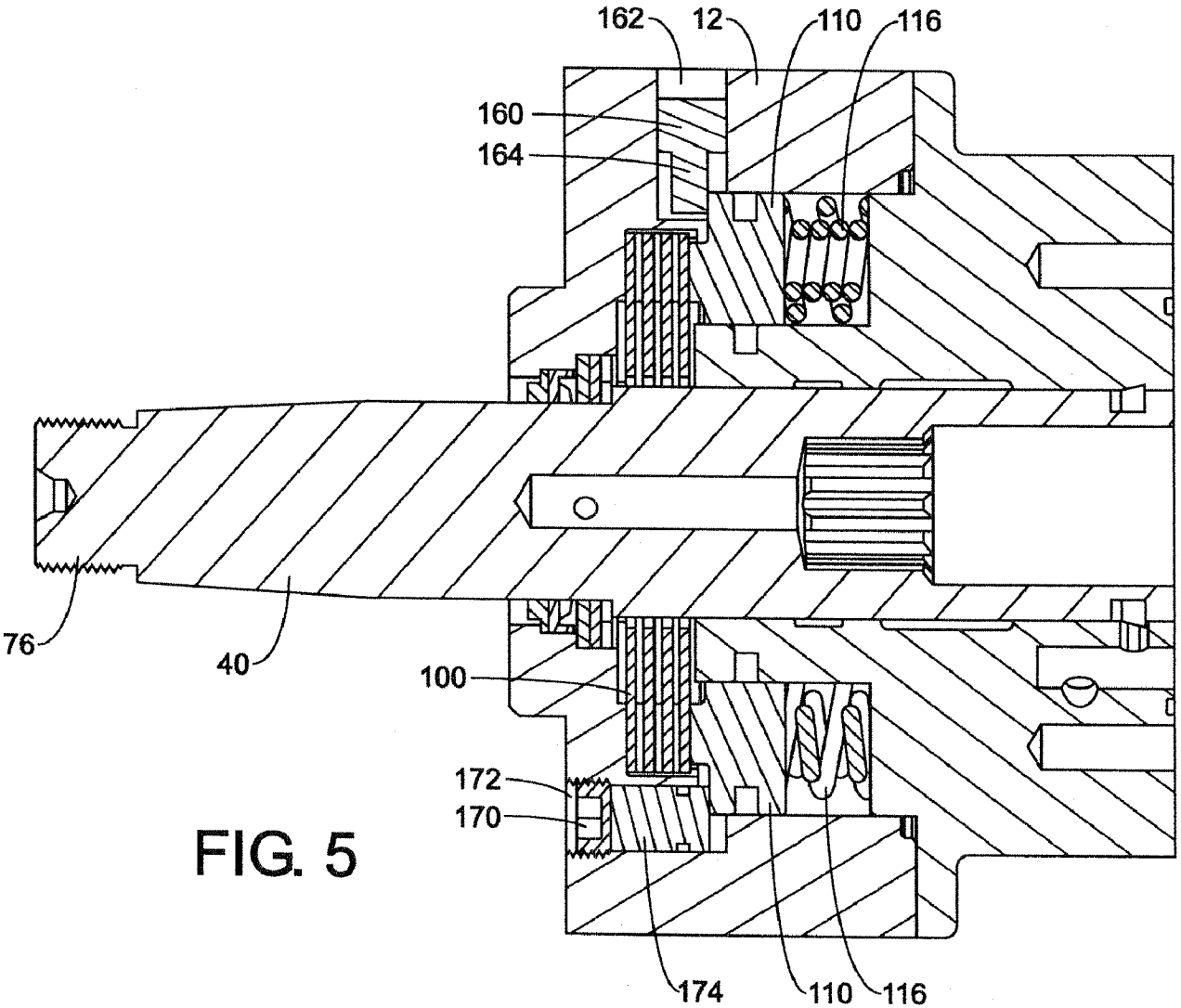
FIG. 5 is a sectional view of a hydraulic device (the rotor assembly is not shown) depicting two mechanical mechanisms for releasing the brake assembly of the hydraulic device.

FIG. 5 shows alternative means for disengaging the brake assembly when pressure is not being delivered to the brake pressure chamber 100. In the upper portion of the embodiment depicted in FIG. 5, a set screw 160 is received in a threaded opening 162 formed in the front housing section 12. The set screw 160 includes an eccentric extension 164 that contacts the piston 110. The set screw 160 is rotated so that the eccentric extension 164 urges the piston 110 towards the springs 116 thus deactivating the brake assembly. The threaded opening 162 is radially aligned with the rotational axis of the output shaft 40 and may be more easily accessible when a wheel (not shown) is attached to the output end 76 of the output shaft 40 as compared to the means for releasing the brake which will be described below.

With respect to the lower portion of the embodiment depicted in FIG. 5, a set screw 170 is received in a threaded passage 172 that is parallel with the rotational axis of the output shaft 40. Tightening of the set screw 170 moves a plug 174 disposed in the opening 172 towards the piston 110 urging the piston towards the spring 116 thus deactivating the brake 100. Either set screw 160 or 170 moves a member, either linear or rotational movement, that moves the piston towards the spring. A hydraulic device may employ only one type of the aforementioned mechanical release mechanisms. More than one of the same type of release mechanisms may be employed in a single hydraulic device.

A compact hydraulic motor and brake assembly has been described. Modifications and alterations will occur to those upon reading and understanding the preceding detailed description. The invention is not limited to only the embodiments disclosed above. Instead, the invention is broadly defined by the appended claims and the equivalents thereof.

The invention claimed is:

1. A hydraulic device comprising:

a housing having a central opening, an inlet port, and an outlet port, the housing at least partially defining a pressurizable brake chamber;

an output shaft received in the central opening and extending from the housing, wherein the output shaft includes a fluid passage in communication with the pressurizable brake chamber;

a rotor assembly comprising a stator and a rotor having cooperating teeth defining fluid pockets, the rotor rotating and orbiting relative to the stator when hydraulic fluid is directed toward the fluid pockets, the fluid pockets being in communication with the inlet port and the outlet port;

a wobble shaft connected to the rotor and to the output shaft; and a brake assembly including a first brake disk connected to the output shaft, a second brake disk connected to the housing, a piston contacting at least one of the brake disks and a biasing member urging the piston toward the brake disks, wherein the inlet port connects to the brake chamber to supply pressurized fluid to the brake chamber through the fluid passage in the output shaft to urge the piston away from the brake disks.

2. The device of claim 1 further comprising a valve positioned in a fluid path between the fluid inlet port and at least one of the fluid pockets of the rotor assembly, wherein the valve allows flow from the rotor assembly toward the central opening and precludes pressurized fluid from the inlet port to the rotor assembly.

3. The device of claim 2, wherein the valve checks flow in one direction.

4. The device of claim 1, further comprising a seal cooperating with the output shaft and the housing to define a boundary of the pressurizable brake chamber.

5. The device of claim 1, wherein the housing and the piston at least partially define a biasing member chamber, the biasing member being disposed in the biasing member chamber, the biasing member chamber being in fluid communication with the outlet port.

6. A hydraulic device comprising:

a housing having a central opening, an inlet port, and an outlet port, the housing at least partially defining a pressurizable brake chamber;

an output shaft received in the central opening and extending from the housing;

a rotor assembly comprising a stator and a rotor having cooperating teeth defining fluid pockets, the rotor rotating and orbiting relative to the stator when hydraulic fluid is directed toward the fluid pockets, the fluid pockets being in communication with the inlet port and the outlet port;

a wobble shaft connected to the rotor and to the output shaft;

a brake assembly including a first brake disk connected to the output shaft, a second brake disk connected to the housing, a piston contacting at least one of the brake disks and a biasing member urging the piston toward the brake disks, wherein the inlet port connects to the brake chamber to supply pressurized fluid to the brake chamber through a fluid passage in the output shaft urging the piston away from the brake disks; and a valve disposed in a fluid path between the rotor assembly and the brake chamber, wherein the valve, the fluid path between the rotor assembly and the brake chamber, the housing and the inlet and outlet ports being configured such that when pressurized fluid is delivered into either port pressurized fluid is delivered the brake chamber to bias the piston away from the brake disks.

7. The device of claim 6, wherein the output shaft includes a fluid passage in communication with the brake chamber, wherein the inlet port connects to the brake chamber to supply pressurized fluid to the brake chamber through the fluid passage in the output shaft urging the piston away from the brake disks.

8. The device of claim 7, wherein at least one of the housing and the output shaft includes a release port in fluid communication with the brake pressure chamber.

9. A hydraulic device comprising:

a housing having a central opening, a first port, and a second port, the housing at least partially defining a pressurizable brake chamber connected with the each port via a fluid path within the housing;

an output shaft received in the central opening and extending from the housing;

a rotor assembly comprising a stator and a rotor having cooperating teeth defining fluid pockets, the rotor rotating and orbiting relative to the stator when hydraulic fluid is directed toward the fluid pockets, the fluid pockets being in communication with the first port and the second port;

a wobble shaft connected to the rotor and to the output shaft to rotate the output shaft upon rotational and orbital movement of the rotor;

a first brake disk connected to the output shaft;

a second brake disk connected to the housing;

a piston disposed in the housing;

a first seal contacting the piston and the housing to separate the brake chamber from a cavity;

a biasing member in the cavity urging the piston toward the brake disks; and a second seal cooperating with the housing and the output shaft to define a boundary of the brake chamber.

10. The device of claim 9, wherein the brake disks are disposed in the brake chamber between the first seal the second seal.

11. The device of claim 9, wherein the output shaft includes first axial slots and second axial slots radially offset from the first axial slots.

* * * * *